US006599149B2

(12) United States Patent
Chen

(10) Patent No.: US 6,599,149 B2
(45) Date of Patent: Jul. 29, 2003

(54) PATCH PANEL

(75) Inventor: Michael Chen, Keelung (TW)

(73) Assignee: Surtec Industries, Inc., Keelung (TW)

( * ) Notice: Subject to any disclaimer, the term of this patent is extended or adjusted under 35 U.S.C. 154(b) by 0 days.

(21) Appl. No.: 10/032,474

(22) Filed: Jan. 2, 2002

(65) Prior Publication Data

US 2003/0124908 A1 Jul. 3, 2003

(51) Int. Cl.[7] ..... H01R 13/74
(52) U.S. Cl. ..... 439/565
(58) Field of Search ..... 439/550, 544, 439/563, 565, 562

(56) References Cited

U.S. PATENT DOCUMENTS 4,812,133 A * 3/1989 Fleak et al. ..... 439/565
4,863,398 A * 9/1989 Steenton et al. ..... 439/565
5,632,648 A 5/1997 Liu ..... 439/550

* cited by examiner

*Primary Examiner*—Gary Paumen
(74) *Attorney, Agent, or Firm*—Birch, Stewart, Kolasch & Birch, LLP

(57) ABSTRACT

A patch panel in which an adapter and a panel can be installed on the framework of a machine with fewer components. A catch and a flange can be fitted and pegged to one another on the adapter and the panel, so when the adapter and the panel are separately positioned at the front and rear of the machine framework respectively, the catch and the flange will lock onto each other and enable the adapter and the panel to be held tightly on either side of the machine framework, thus completing the assembly without the use of any screws.

6 Claims, 6 Drawing Sheets

PATCH PANEL

FIELD OF THE INVENTION

The invention relates to a type of patch panel, and more particularly to the structure and assembly of a patch panel's adapter and panel on a machine framework.

BACKGROUND OF THE INVENTION

To meet the demands of expandability and transmission capability, computers and their peripheral devices are usually equipped with adapters that can connect to other devices through the use of cables. A patch panel is disclosed in the U.S. Pat. No. 5,632,648. FIG. 1 is a diagram showing the structure of a known combination of an adapter 10 and a machine framework 20 as disclosed by this patent. The adapter 10 is a type of a jack 12 and an IDC 13, which comprises a circuit board 11 and a mutual connection fixed on the circuit board 11 by means of the printing circuit of the circuit board 11. The jack 12 provides a connection for a plug, whereas the IDC 13 connects with a cable (particularly to a twisted-pair cable). As shown in the Figure, the adapter 10 is fixed on the inside of the machine framework 20 by means of screws 14. This kind of installation method is not only time-consuming, but also requires the use of tools in order to fasten the screws 14 tightly. In addition, this kind of installation method does not allow a port to be marked.

Due to the inconvenience mentioned above of having to fasten an adapter 10 onto a machine framework 20 with screws 14, the said patent proposes another means for installing the adapter 10 on the machine framework 20. As shown in FIG. 2, the means adopted by the said patent primarily involves fixing the adapter 10 onto the machine framework 20 with a front panel 15, a rear compression panel 16, and several screws 14. The front panel 15 is made of plastic, and it is placed at the front of the machine framework 20, so that it provides the function of displaying the marking of a port. In this said design, the adapter 10 is sandwiched between the front panel 15 and rear compression panel 16 at the machine framework, with the front panel 15 in front of it, and the rear compression panel 16 behind it. Although this design requires fewer screws the use of screws is still necessary for the installation.

SUMMARY OF THE INVENTION

In view of this, the primary objective of the invention is to propose a patch panel that has a simplified structure and is easy to install.

To achieve the aforesaid objective, the invention proposes a patch panel where an adapter and a panel can be installed on a machine framework with fewer components. Primarily, there is a separately allocated catch and flange that can be fitted and pegged to one another on the adapter and the panel, where the adapter and panel can be separately allocated at the front and rear of the machine framework, respectively, and the adapter and panel can further be held together tightly on either side of the machine framework by having the catch and flange fitted and locked to each other, thus achieving the objective of installing the adapter onto the machine framework without the use of any screws at all.

To further illustrate the detailed characteristics of the invention, a preferred embodiment is provided below with drawings attached.

DESCRIPTION OF THE PREFERRED EMBODIMENT

Figure 1:
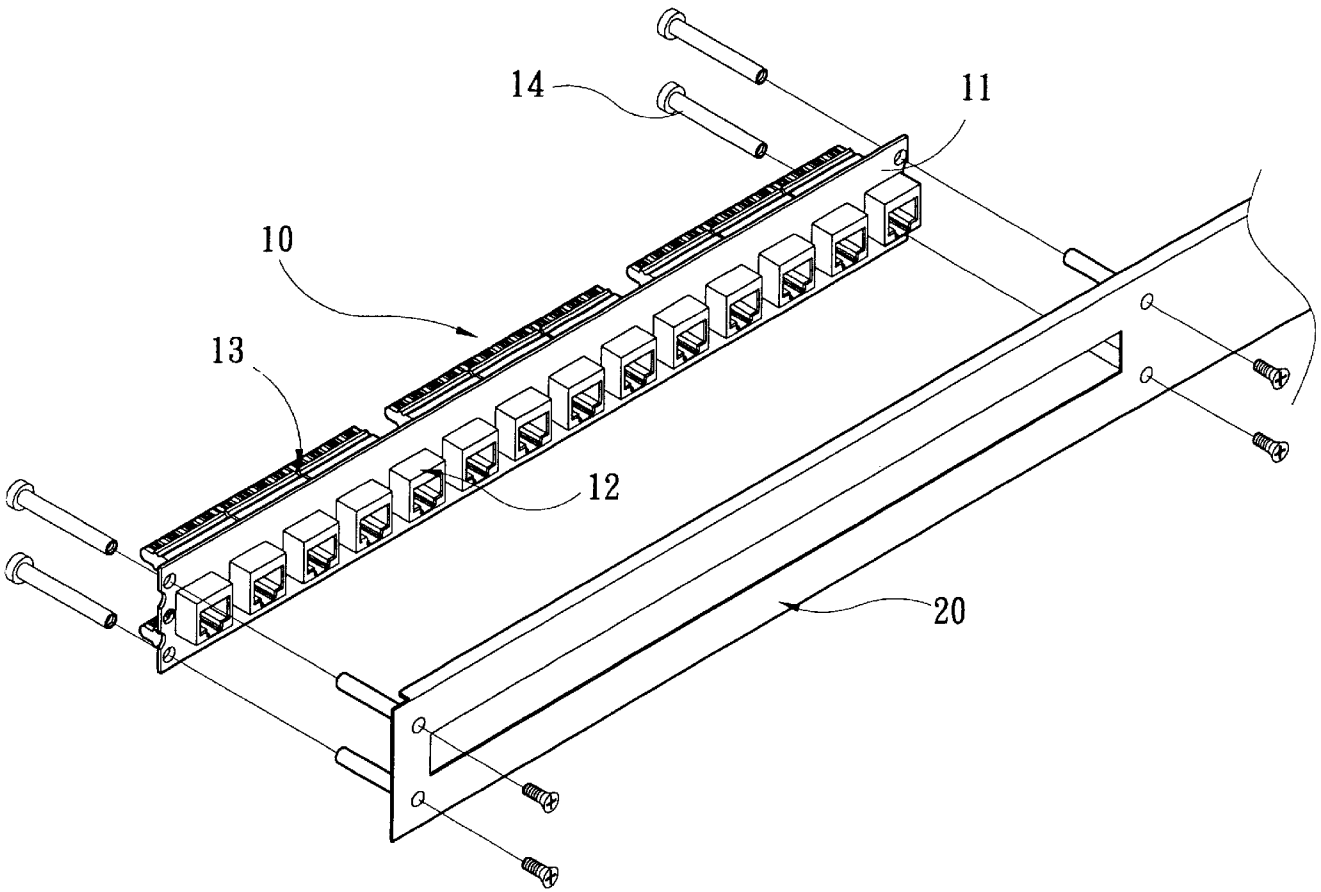
FIG. 1 PRIOR ART
FIG. 1 shows the structure of a known embodiment for installing an adapter on a machine framework.
Figure 2:
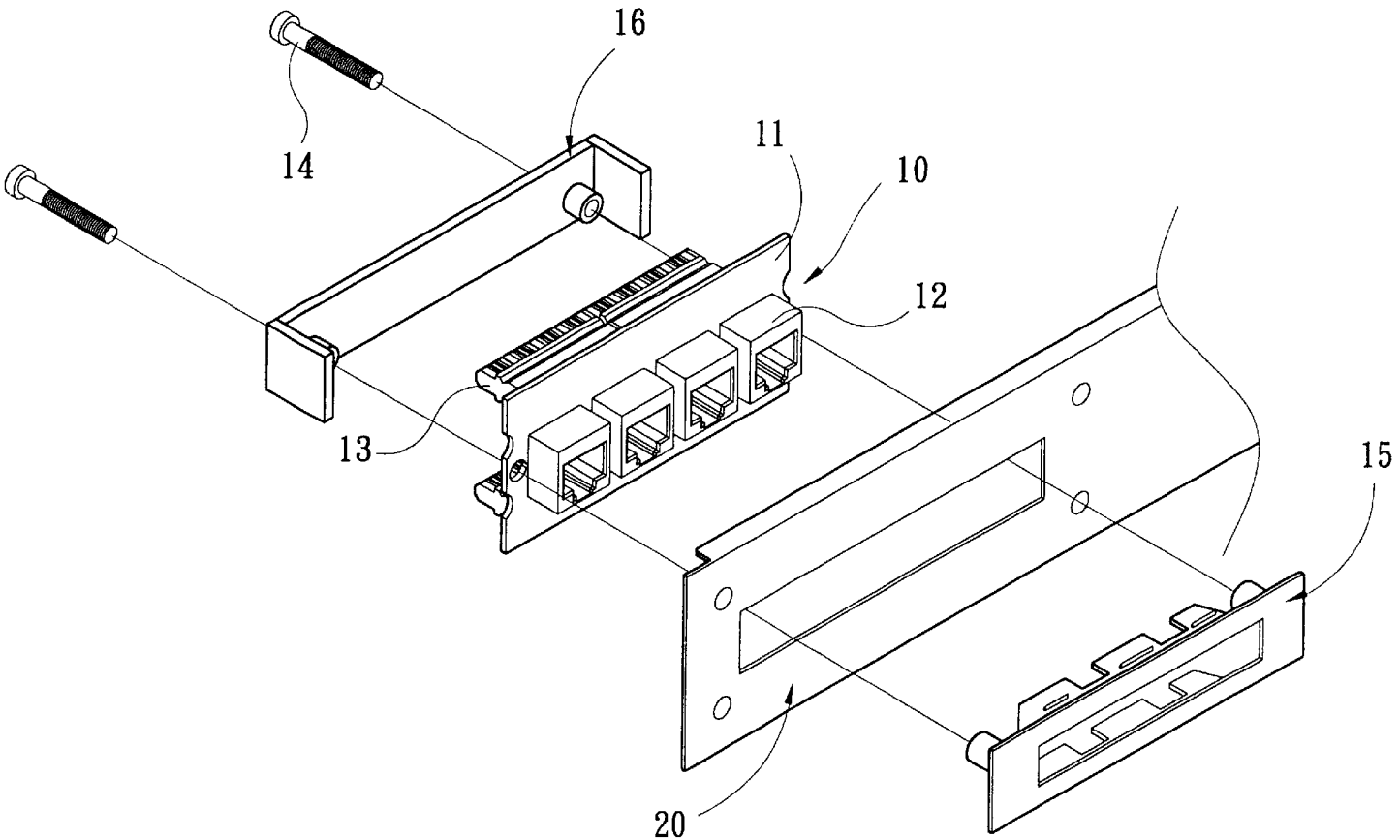
FIG. 2 PRIOR ART
FIG. 2 shows the structure of a known embodiment for installing an adapter on a machine framework.
Figure 3:
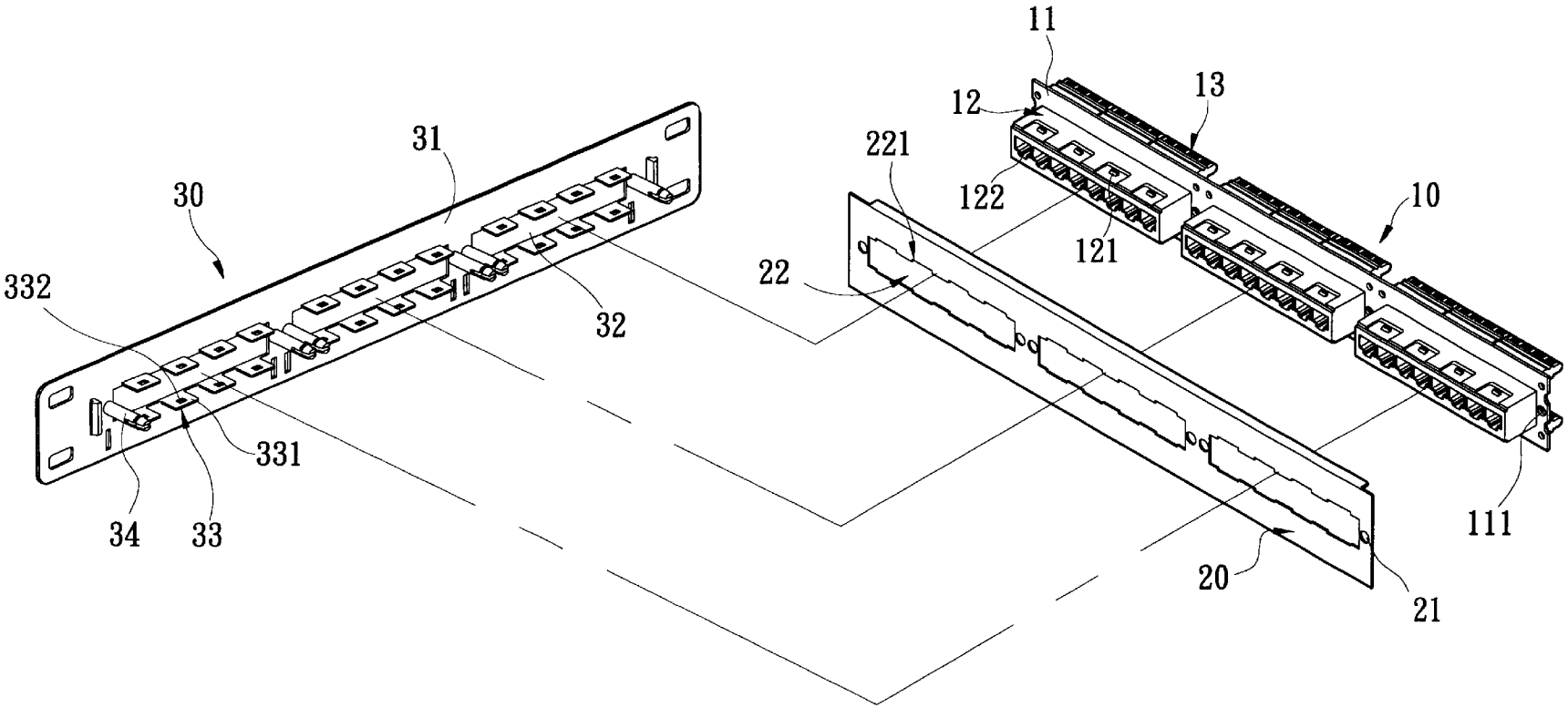
FIG. 3 is a 3-D diagram, schematically showing a disassembled patch panel of a preferred embodiment proposed by the invention.

Please refer to FIG. 3, which shows the structure of the preferred embodiment of the invention. It illustrates a patch panel that comprises:

An adapter 10 comprising a circuit board 11, a jack 12 and an IDC 13 which are fixed on the circuit board 11 and are connected to each other by means of the printing circuit of the circuit board 11; a plug can be inserted into the insertion holes 122 of the jack 12 (not shown in the figure); the IDC 13 is connected to a cable (particularly to a twisted-pair cable);

A machine framework 20—a component for supporting the adapter 10. It is usually a metal plate fixed onto a frame (not shown in the figure) fixed on the ground. There are some first holes 22 on the machine framework 20. Whenever the adapter 10 is installed behind the machine framework. 20, the jack 12 may be passed through one of the first holes 22 and be exposed. For instance, this kind of machine framework 20 is always found in a machine room for the management of this kind of communication equipment, and even a hub or a router frequently used in networking can be installed in this kind of machine framework;

A panel 30 that comprises a planar panel 31 lying against the front side of the machine framework 20. On the machine framework 20, a second hole 32 is found in the same place where the first hole 22 is. The second hole 32 allows the jack 12 to be exposed whenever the panel 30 is installed on the machine framework 20;

In the embodiment illustrated in FIG. 3, the circuit board 11 of the adapter 10 appears as a single plate. There are several groups of jacks 12 and IDCs 13. Each group has several jacks 12 that belong exclusively to the group, jointly forming an adapter 10 that is equipped with a plurality of ports. As regards the panel 30, a single panel 30 may be used whenever a single circuit board 11 is used.

Figure 6:
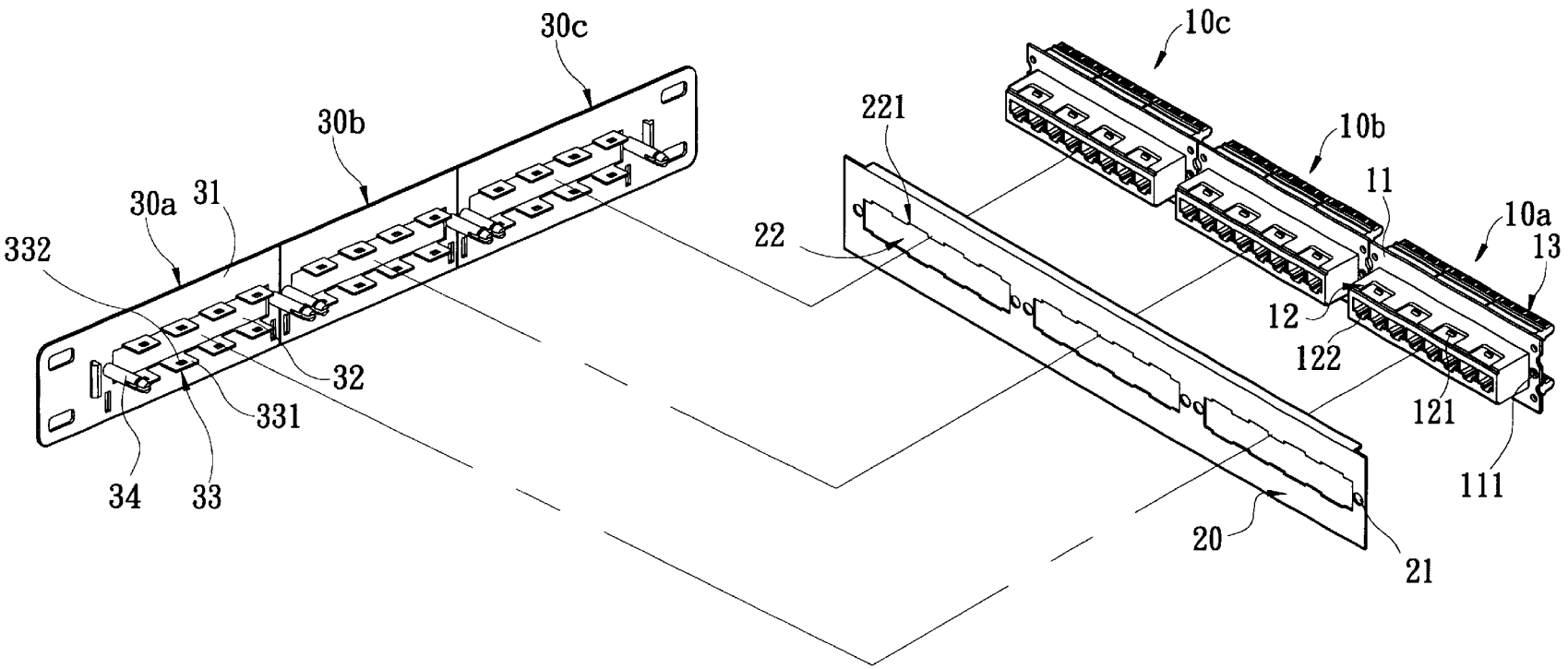
FIG. 6 shows the structure of another embodiment of the invention.

As shown in another embodiment illustrated in FIG. 6, several independent adapters 10*a*, 10*b* and 10*c* may be used. Each group has several jacks 12. Several panels 30 may be used, corresponding to the several independent adapters 10*a*, 10*b* and 10*c*. The panels 30*a*, 30*b* and 30*c* and the adapters 10*a*, 10*b* and 10*c* may be installed on the machine framework 20.

To allow an adapter 10 and a panel 30 to be installed together on a machine framework 20, the invention proposes the following design that does not require the use of any screws.

There are several catches 121 and flanges 33 on the jack 12 of the adapter 10 and the panel 30, respectively. The catch 121 and flange 33 can lock with each other. The catch 121 is installed on both sides of the jack 12, while a flange 33 is installed at the back of the panel 30 (facing the machine framework 20 and the adapter 10). The flange 33 comprises a sheet 331 that sticks out backward along the margin of the second hole 32 as well as a hooked hole 332 found on the sheet 331. The adapter 10 and the panel 30 lie against the front and the back of the machine framework 20, respectively. The flange 33 passes through the margin of the first hole 22 of the machine framework 20 and reaches the catch 121 installed on both sides of the jack 12. The catch 121 then locks the hooked hole 332 found on the flange 33. To allow the flange 33 to pass through the margin of the first hole 22 of the machine framework 20 smoothly, it is necessary to have a dented gap 221 on the margin of the first hole 22.

Figure 4:
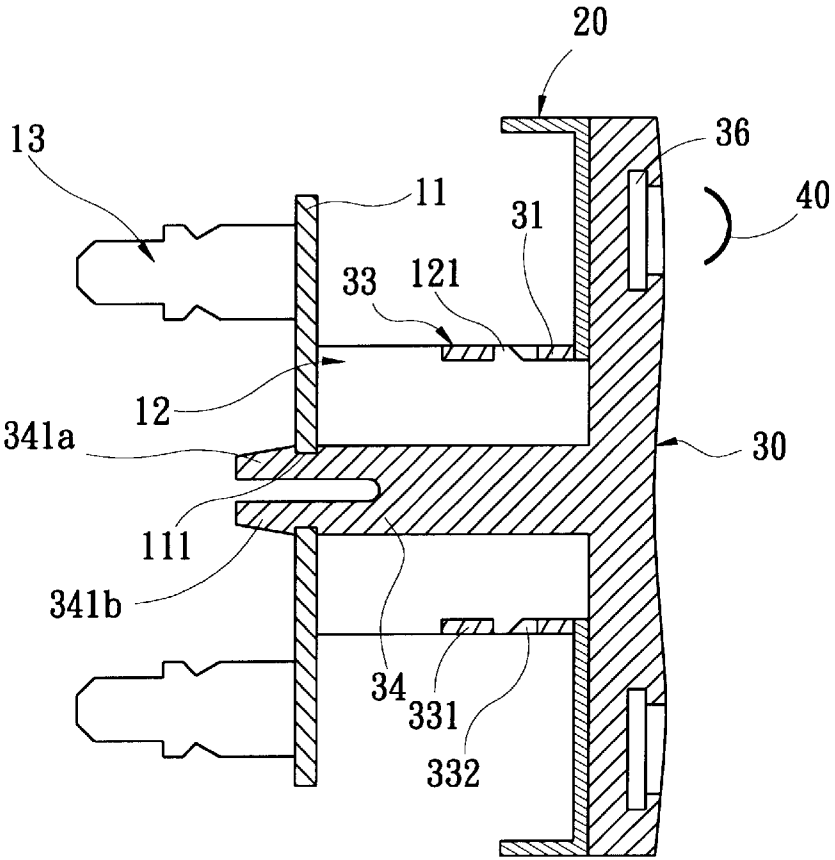
FIG. 4 is a cross-section diagram showing the assembled structure of the components disclosed by FIG. 3.

In another preferred embodiment of the invention, in order to allow the adapter 10, the machine framework 20 and the panel 30 to work closely, on the back of the panel 30 there are several fasteners 34 protruding backward. After passing through the third hole 21 of the machine framework 20, the fasteners 34 lock onto the fourth hole 111 of the circuit board 11. In the preferred embodiment of the invention, the ends of the fasteners are forked, possessing at least two tailed hooks 341*a* and 341*b* (as shown in FIG. 4). The ends of the tailed hooks 341*a* and 341*b* are cone-shaped. When this pair of tailed hooks 341*a* and 341*b* pass through the fourth hole 111 of the circuit board 11, they open and lock the fourth hole 111.

When the adapter 10 is placed in front of the machine framework 20 and the panel 30 is placed behind the machine framework 20, the adapter 10 and the panel 30 are held tightly on either side of the machine framework 20 because the catch 121 and the flange 33 lock with each other. In the meantime, the fasteners 34 also pass through the third hole 21 in the front of the machine framework 20, and eventually lock the fourth hole 111 of the circuit board 11, so that the panel 30 and the adapter 10 are held tightly on either side of the machine framework 20 (as shown in FIG. 4).

As indicated in the above explanations, the adapter 10 can be fixed on the machine framework 20 by means of the interactive locking relationship of the aforesaid panel 30. The invention is not only fast and easy to operate, but it also requires the use of no tools. The invention completely eliminates the inconvenience caused by the use of screws and avoids the problem of the unattractive appearance of the screws. In addition, the invention involves a streamlined combination of components, thus simplifying the process of the assembly of adapters 10, and cutting manufacturing cost.

Figure 5:
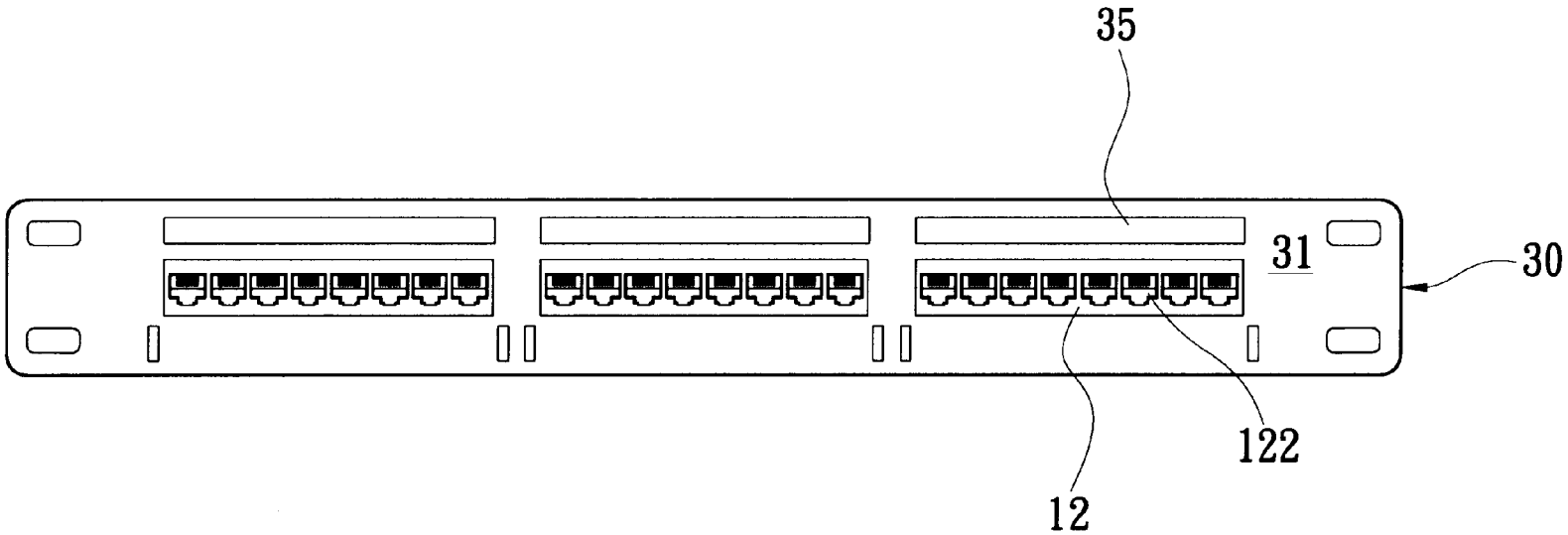
FIG. 5 is a layout showing the patch panel of the invention.

Please refer to FIG. 5. This figure shows the condition of the front of the panel 30. In addition to its combination and fixation effect, the panel 30 also has, in practice, at least a marking region 35 on its front surface. The marking region 35 shows images, symbols and text blocks, or as indicated in the structure shown in FIG. 4, the marking region 35 is designed to be a sunken label slot 37. Whenever a label 40 becomes flattened because of its own elasticity, it will be embedded right in the label slot 37. As a result, the purpose of each insertion hole of the jack 12 or a title can be indicated.

EFFECT OF THE INVENTION

As disclosed by the above explanations, the patch panel of the invention is a structure that enables an adapter to be installed and fixed on a machine framework 20. The adapter is fixed on the machine framework 20 by being locked on the machine framework 20, and the locking process is fast and convenient. In addition, the patch panel provides a marking function, indicating clearly the title or the purpose of every input/output port of the adapter 10.

While the invention has been described by way of examples and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A patch panel comprising:

an adapter including a circuit board, a jack and an IDC, said jack and IDC being fixed on the circuit board and connected to each other by means of a printing circuit on the circuit board, the jack being equipped with several catches found on both sides of the jack;

a plate-shaped machine framework for supporting the adapter, said framework including a plurality of first holes, so that whenever the adapter is installed behind the machine framework, the jack passes through the first holes to be exposed; and a planar panel lying against a front of the machine framework, said panel including a plurality of second holes which allow the jack to be exposed, and a plurality of flanges on the back of the panel for locking the catches.

2. The patch panel according to claim 1, wherein each flange is made of a sheet that sticks out backward along the margin of the second hole and includes a hooked hole on the sheet.

3. The patch panel according to claim 1, further comprising:

a plurality of fasteners on the panel; and a third hole on an area of the adapter corresponding to the fasteners, so that the fasteners pass through the third hole and are locked on the circuit board.

4. The patch panel according to claim 3, wherein ends of the fasteners are forked and have at least two tailed hooks.

5. The patch panel according to claim 1, further comprising at least one marking region on an external side of the panel.

6. The patch panel according to claim 5, wherein the marking region is a label slot.

* * * * *